US005996393A

United States Patent [19]

Buttleman et al.

[11] Patent Number: 5,996,393

[45] Date of Patent: Dec. 7, 1999

[54] EXTRUSION DIE FOR TUNGSTEN ALLOYS

[75] Inventors: Dennis P. Buttleman, Athens; Phillip D. Wurzler, Laceyville; Kenneth D. Brown, Ulster, all of Pa.

[73] Assignee: Osram Sylvania Inc., Danvers, Mass.

[21] Appl. No.: 09/027,837

[22] Filed: Feb. 23, 1998

[51] Int. Cl.[6] ..... B21C 25/02

[52] U.S. Cl. ..... 72/467; 72/253.1

[58] Field of Search ..... 72/467, 253.1, 72/272

[56] References Cited

U.S. PATENT DOCUMENTS

| | | | |
|---|---|---|---|
| 4,051,706 | 10/1977 | Sakamoto | 72/253.1 |
| 4,521,360 | 6/1985 | Fiorentino | 72/253.1 |

FOREIGN PATENT DOCUMENTS

| | | | |
|---|---|---|---|
| 1244694 | 7/1967 | Germany | 72/467 |
| 202917 | 12/1982 | Japan | 72/253.1 |
| 1237284 | 6/1986 | U.S.S.R. | 72/467 |
| WO 90/14177 | 11/1990 | U.S.S.R. | 72/467 |
| 759976 | 10/1956 | United Kingdom | 72/467 |

*Primary Examiner*—Daniel C. Crane
*Attorney, Agent, or Firm*—Robert F. Clark

[57] ABSTRACT

A method and apparatus has been developed for the work hardening of tungsten alloy rods while achieving a high degree of diametrical control. The method employs multiple extrusions through extrusion dies designed to prevent cracking and delamination of the rods.

10 Claims, 5 Drawing Sheets

EXTRUSION DIE FOR TUNGSTEN ALLOYS

TECHNICAL FIELD

This invention is related to the extrusion of tungsten alloys. More particularly, this invention is related to an extrusion die for use in a multiple extrusion process for forming tungsten alloy rods.

BACKGROUND OF THE INVENTION

Work hardening of tungsten alloy rods is typically conducted using a swaging process. In the swaging process, the rod is work hardened, i.e., reduced in diameter, in one or more steps to achieve the desired material properties for a given application. However, for certain applications where tight tolerances are mandated, the swaging process is inefficient because it cannot consistently produce the desired material properties nor can it produce rods having strict dimensional tolerances without additional finishing steps. For example, ultimate tensile strength and yield strength may vary by 15 Ksi and total diameter by ±0.003 inch. Variations in the material properties and in the dies used in the swager during the metal working operation are the principal causes of these inefficiencies. To achieve the necessary diametrical control when swaging is used, the rods have to be left oversized so that they can be ground to the required diameter, a step which yields about 5% scrap. This finishing work adds to the cost of manufacturing by increasing both labor and materials costs.

Thus, it would be an advantage to have a process whereby tungsten alloy rods could be more efficiently and consistently work hardened while achieving a greater degree of diametrical control.

SUMMARY OF THE INVENTION

It is an object of the invention to obviate the disadvantages of the prior art.

It is another object of the invention to provide an extrusion die for extruding tungsten alloy rods.

It is a further object of the invention to provide a method for extruding tungsten alloy rods with a high degree of diametrical control.

In accordance with one object of the invention, there is provided an extrusion die for extruding tungsten alloy rods, the die comprising:

a case having a forming piece;

the forming piece having a bore therethrough, the bore having a central axis, a first section, a neck and a second section, the forming piece being made of a high hardness material having a hardness of at least about 93.8 RA;

the first section, the neck and the second section being cylindrical and coaxial with the central axis of the bore of the forming piece, the neck being interposed between the first and second sections;

the first section having a diameter sufficient to accept the tungsten alloy rod, a first taper interposed between the first section and the neck forming an approach angle with the central axis of the bore, the approach angle being no greater than about 9 degrees, the neck having a diameter less than the diameter of the first section and sufficient to reduce the diameter of the tungsten rod;

the second section having a diameter larger than the diameter of the neck and sufficient to accept the tungsten rod after extrusion through the neck, a second taper interposed between the neck and the second section and forming an exit angle with the central axis of the bore.

In accordance with a another object of the invention, there is provided a method for forming tungsten alloy rods comprising:

a first extrusion wherein the tungsten alloy rod is extruded through a first extrusion die whereby the tungsten alloy rod is work hardened by up to about 14%; and a second extrusion wherein the tungsten alloy rod is extruded through a second extrusion die to form a finished tungsten alloy rod having a predetermined diameter, each extrusion die being constructed to prevent cracking or delamination of the tungsten alloy rod.

DESCRIPTION OF THE PREFERRED EMBODIMENTS

For a better understanding of the present invention, together with other and further objects, advantages and capabilities thereof, reference is made to the following disclosure and appended claims taken in conjunction with the above-described drawings.

We have discovered that tungsten alloy rods may be worked hardened while being formed to exacting dimensional requirements without employing additional finishing steps. In the method of this invention, multiple extrusions are made through specially designed extrusion dies in order to produce the proper amount of work hardening. The final extrusion die used in the last extrusion step is sized to yield the desired final diameter for the rod. Each extrusion die used in the process is constructed to prevent cracking or delamination of the material as it is being worked. The multiple extrusion process is capable of producing properly work hardened pieces while achieving a high degree of diametrical control. Because no grinding is needed, the loss of material is minimized and confined to those instances where the rod must be machined to a finished product shape which departs from its right cylindrical shape. As used herein, the term tungsten alloy rods includes tungsten rods. Examples of tungsten alloys usable in the multiple extrusion process are tungsten nickel iron (WNiFe) or tungsten nickel cobalt alloys (WNiCo) containing between 85 and 97 weight percent (wt. %) tungsten.

Figure 1:
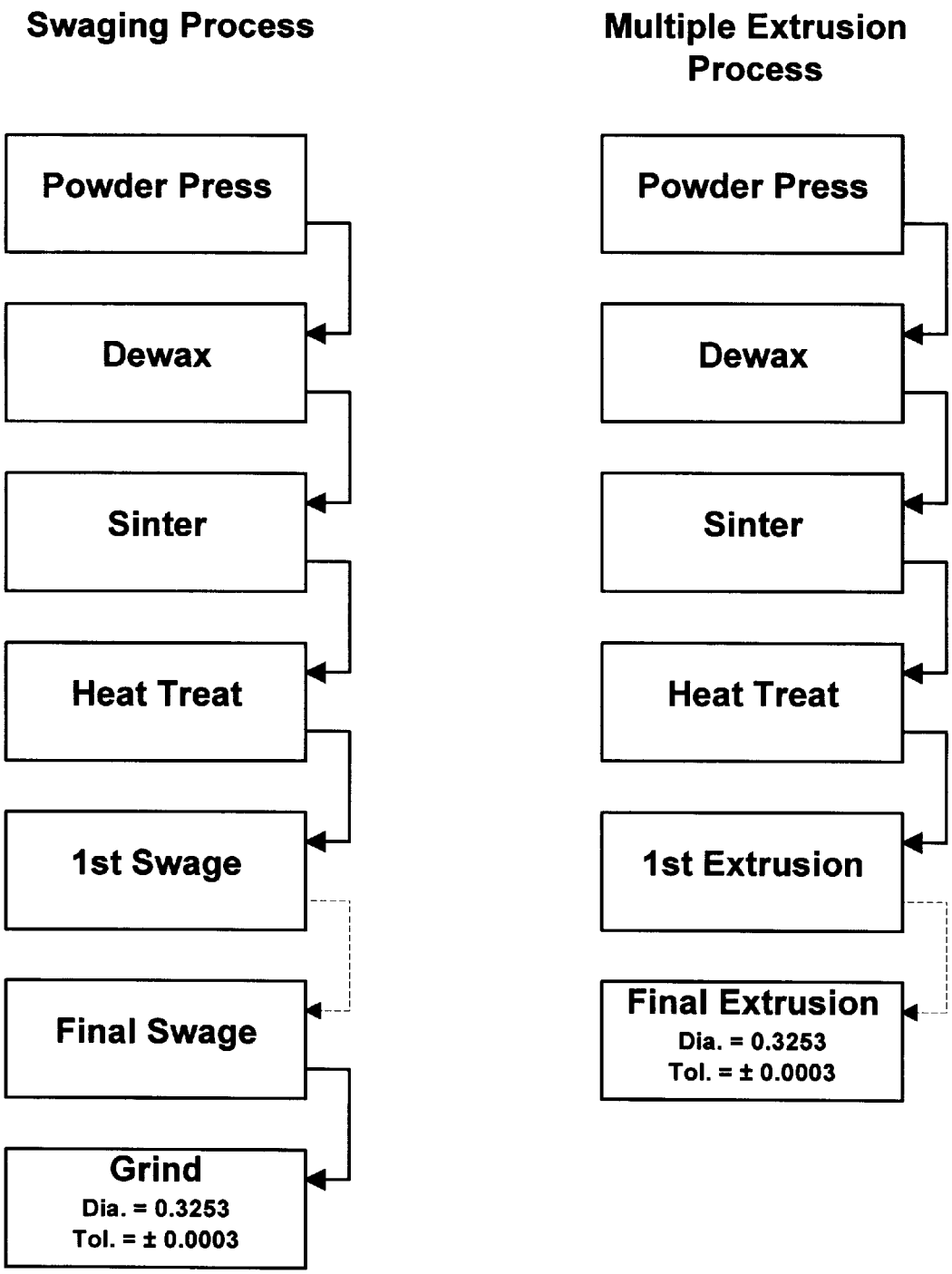
FIG. 1 is a flow diagram of the process steps used in the prior art swaging process compared with the process steps used in an embodiment of the multiple extrusion process of this invention.

An embodiment of the multiple extrusion process is shown in FIG. 1 and is contrasted with a typical swaging method. Each method begins with the same conventional powder metallurgical steps. Tungsten or tungsten alloy powder containing a lubricating wax is pressed at 25 to 40 Ksi into a cylindrical shape, the pressed cylindrical piece is heated to approx. 600° C. in dry hydrogen to remove the wax, and then sintered at approx. 1500° C. in wet hydrogen. The pressed and sintered rods are then heat treated in order to remove hydrogen and impurities. After the heat treatment, the two methods diverge. The swaging process continues with multiple swaging steps with the first used to equalize the rod diameter and further steps to reduce diameter and alter properties. A final grinding step is required to reach the finished diameter and tolerance. The multiple extrusion process uses two extrusion steps to reach the same degree of work hardening but does not require the grinding step to reach the final diameter and tolerance.

The first extrusion in the process shown in FIG. 1 is designed to work harden the rod by up to a maximum of about 14% (i.e., the rod's diameter is reduced by up to a maximum of about 14%). The rod is then passed through a second extrusion die which extrudes the rod to the final diameter. A slight expansion or recovery of the rod is observed as it comes through the extrusion die. This is normally around 0.0003 inch on a 0.300 inch diameter part but may vary due to alloy differences and size. This expansion requires that the die be tuned to the actual material flowing through the tooling to account for the expansion. Once the final die is tuned to yield the desired diameter in the extruded rod, the extruded rods exhibit a very high statistical diametrical control level. A slight amount of bowing was observed in some of the rods coming through the extrusion dies. The worst bow that was found was 0.0009" total indicator reading (TIR) for a part 1¾" in length. Normal variations from 0 to 0.0009" maximum were found in samples taken.

Statistical control process parameters Cp and Cpk have been used to evaluate the diametrical control of the swaging and multiple extrusion processes. Cp, capability potential, represents the ability of the process variation to fit within the desired tolerance. Cpk, centered process capability, compares the actual average of the process with the closest specification limit and balances it against process width. Because these parameters are being used to evaluate diametrical control, they will hereinafter be referred to collectively as the diametrical control values.

Cp is calculated by dividing the specification tolerances by the process capability (6 standard deviations, $6\sigma$), Cp=(upper specification limit−lower specification limit)/$6\sigma$. Cpk is the upper specification limit (USL)−average value (Xbar), or the average value−lower specification limit (LSL), divided by 3 standard deviations, Cpk=(USL−Xbar)/$3\sigma$ or Cpk=(Xbar−LSL)/$3\sigma$. The multiple extrusion process demonstrated exceptional Cp and Cpk values of 3.77 and 3.57, respectively, for tungsten heavy alloy rods having compositions ranging from about 4.6 to 6.0 wt. % 7/3 Ni/Fe (bal. W). Such diametrical control values are significantly better than could be achieved by swaging. Typical Cp and Cpk values measured for the swaging process on the same alloys were 1.7 and 1.2, respectively. In general, it is preferred that the diametrical control values Cp and Cpk both be at least about 1.3. The multiple extrusion process is capable of efficiently yielding Cp and Cpk values of at least about 3.0 each.

Figure 2:
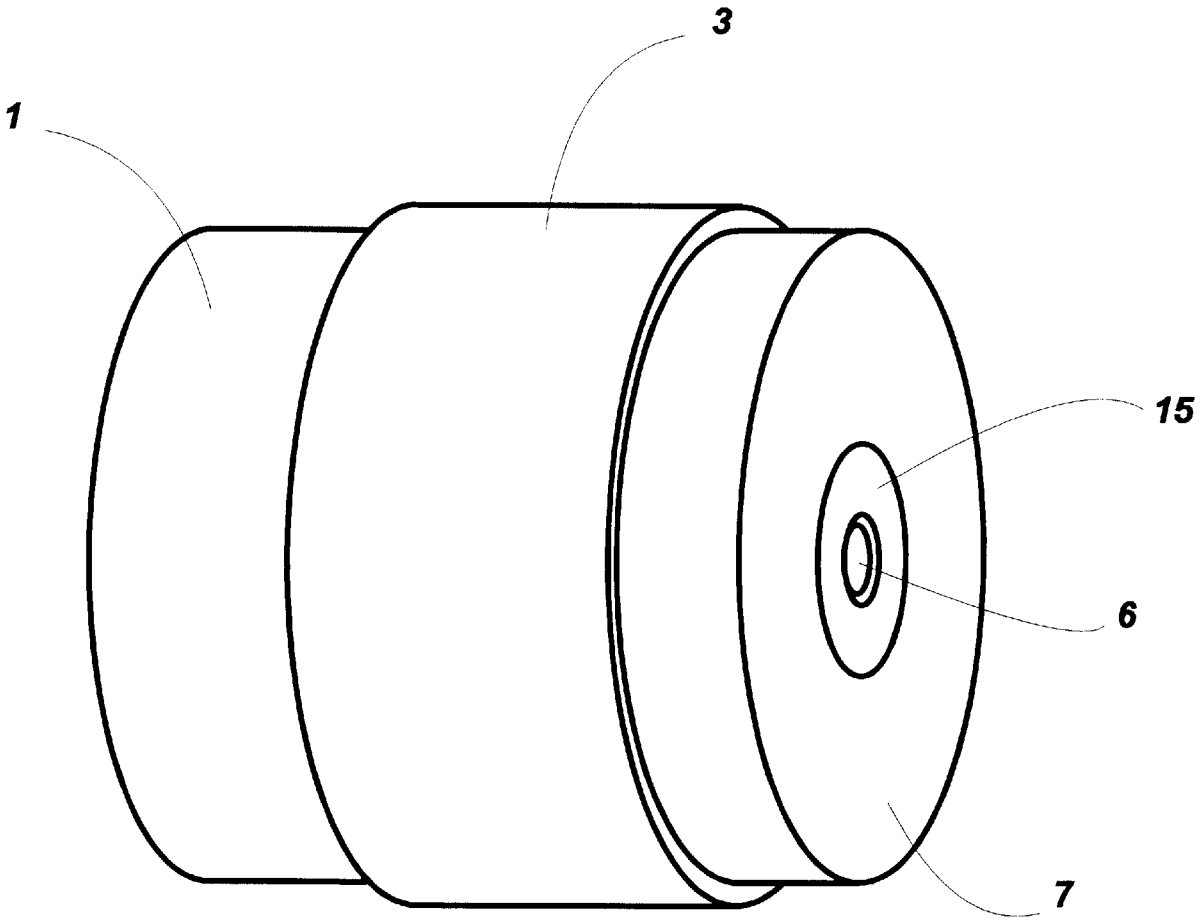
FIG. 2 is an illustration of an embodiment of the extrusion die used in the multiple extrusion process.

As stated previously, the extrusion dies used in the multiple extrusion process are specially designed to prevent delamination or cracking of the rods during extrusion. FIG. 2 is an illustration of a preferred embodiment of the extrusion die used in the multiple extrusion process. The cylindrical case 1 of the die is stepped to form collar 3 which extends around the periphery of the die to enable the die to be clamped into the press table. The case configuration is not critical and can be changed to adapt the die to fit other extrusion presses. It is preferred that the case be made of 4340 steel. The front face 7 of the die is oriented towards the tungsten alloy rod being extruded. The rod enters the die through opening 6 in the guide piece 15. The forming piece (not shown) is positioned inside the case behind the guide piece.

Figure 3:
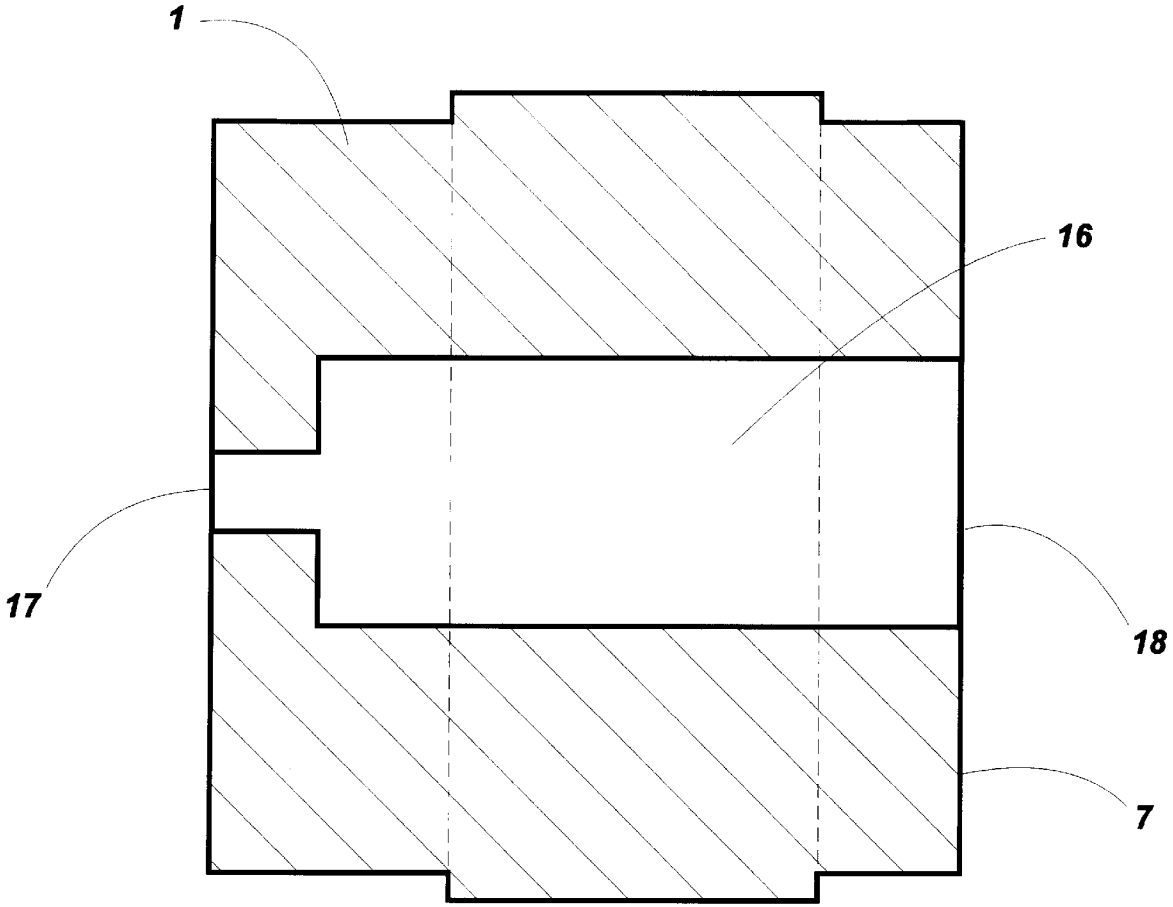
FIG. 3 is a cross-sectional view of the case of the extrusion die shown in FIG. 2.

FIG. 3 is a cross-sectional view of the case shown in FIG. 2 without the guide or forming pieces. The case 1 has cylindrical cavity 16 which has an entrance opening 18 and exit opening 17. The diameter of the cavity is sufficient to receive the guide and forming pieces. Preferably, the cavity is machined to effect an interference fit between the case and the guide and forming pieces so that the latter are tightly held within the case. The entrance opening 18 is in the front face 7 of the die and the exit opening 17 is positioned to pass the tungsten rod out of case 1 after extrusion.

Figure 5:
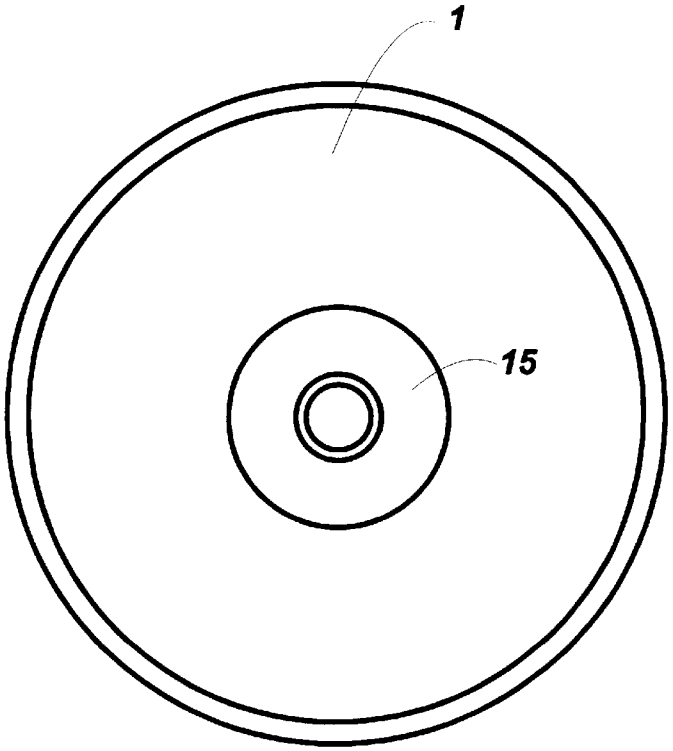
FIG. 5 is a front view of the extrusion die shown in FIG. 2.
Figure 4:
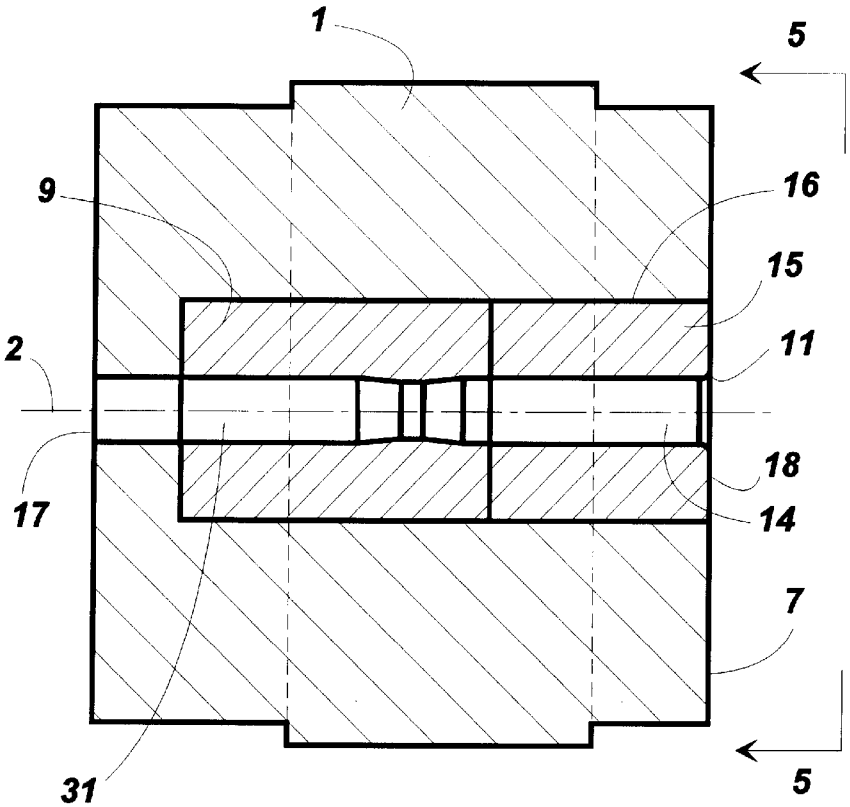
FIG. 4 is a cross-sectional view of the extrusion die shown in FIG. 2. including the forming and guide pieces.

A cross-sectional view of the die including the forming 9 and guide 15 pieces is shown in FIG. 4. Guide piece 15 and forming piece 9 are held within cavity 16 of case 1. Both the guide piece 15 and the forming piece 9 are cylindrical in shape and constructed from a high hardness material having a hardness of at least 93.8 RA (Rockwell A hardness). A preferred material is a cemented tungsten carbide having a hardness of from 93.8 to 94.4 RA, such as Valenite Grade VC-29 (a microgram WC with 6 wt. % Co). The guide piece 15 has cylindrical bore 14 therethrough and is positioned proximal to entrance opening 18 in the front face 7 of the die. Radius 11 on bore 14 facilitates entry of the rod into the guide piece 15. Forming piece 9 is positioned adjacent to guide piece 15 and proximal to exit opening 17. Bore 31 which extends through forming piece 9 has the same central axis 2 as guide piece 15. During extrusion, the tungsten alloy rod passes in succession through guide piece 15, forming piece 9 and exits the die through exit opening 17. A front view of the die is provided in FIG. 5 illustrating the cylindrical shape of the case 1 and guide piece 15.

Figure 6:
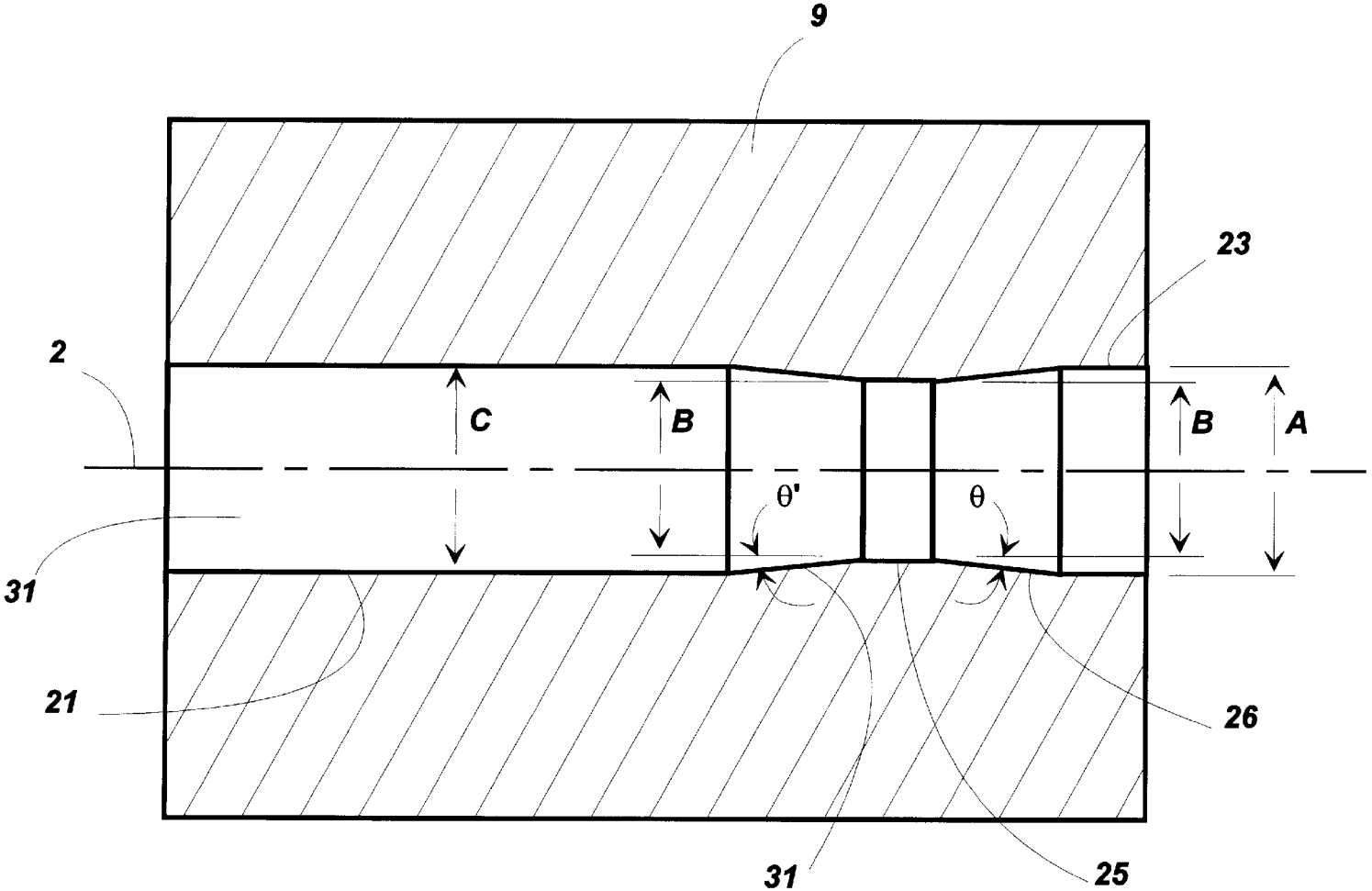
FIG. 6 is an expanded cross-sectional view of the forming piece shown in FIG. 4.

A more detailed cross-sectional view of forming piece 9 is provided in FIG. 6. Bore 31 is divided into three sections: a first section 23, a neck 25 and a second section 21. These sections are cylindrical and coaxial with the central axis 2. The first section 23 having diameter A is positioned adjacent to the guide piece (not shown). Diameter A being sufficient to accept the tungsten alloy rod being extruded. Preferably, diameter A is large enough to accommodate the diameter of the tungsten alloy rod plus the extrusion lubricant. A clearance of about 0.005" is preferred. Also, it is preferred that diameter A be equal to the diameter of the guide piece so that the rod may pass unobstructed from the guide piece into the forming piece.

Neck 25 having diameter B is interposed between first section 23 and second section 21. The neck 25 is preferably between 0.060" and 0.125" in length. A first taper 26 is interposed between neck 25 and first section 23. The first taper 26 forms approach angle $\theta$ with central axis 2. When extruding tungsten alloy rods, it is critical that approach angle $\theta$ be no greater than about 9 degrees and, preferably, from about 3 to about 7 degrees. If approach angle $\theta$ is greater than 10 degrees, the rods develop circumferential or longitudinal cracks during extrusion.

A second taper 31 is interposed between neck 25 and second section 21. The second taper 31 forms exit angle $\theta'$ with central axis 2. The size of exit angle $\theta'$ is not critical. However, it is preferred that exit angle $\theta'$ be from about 3 to about 10 degrees. Diameter B is less than diameter A and sufficient to reduce the diameter of the tungsten alloy rod by between about 3% to about 14%. Additionally, diameter B must be slightly less than the desired resultant diameter in order to account for the slight expansion of the rod after extrusion. Second section 21 has diameter C which is larger than diameter B and sufficient to accept the rod following extrusion through the neck.

While there has been shown and described what are at the present considered the preferred embodiments of the invention, it will be obvious to those skilled in the art that various changes and modifications may be made therein without departing from the scope of the invention as defined by the appended claims. For example, the forming piece and the guide piece may be combined into a single piece or the die itself may be made of a single piece of high hardness material thereby unifying the case with the guide and forming pieces.

We claim:

1. An extrusion die for extruding tungsten alloy rods, the die comprising:

a case having a forming piece;

the forming piece having a bore therethrough, the bore having a central axis, a first section, a neck and a second section, the forming piece being made of a high hardness material having a hardness of at least about 93.8 RA;

the first section, the neck and the second section being cylindrical and coaxial with the central axis of the bore of the forming piece, the neck being interposed between the first and second sections;

the first section having a diameter sufficient to accept the tungsten alloy rod, a first taper interposed between the first section and the neck forming an approach angle with the central axis of the bore, the approach angle being from 3 to about 7 degrees, the neck having a diameter less than the diameter of the first section and sufficient to reduce the diameter of the tungsten rod;

the second section having a diameter larger than the diameter of the neck and sufficient to accept the tungsten rod after extrusion through the neck, a second taper interposed between the neck and the second section and forming an exit angle with the central axis of the bore, the exit angle being from about 3 to about 10 degrees.

2. The extrusion die of claim 1 wherein the neck has a diameter sufficient to reduce the diameter of the tungsten alloy rod by up to about 14%.

3. The extrusion die of claim 1 wherein the case further contains a guide piece, the guide piece being composed of the high hardness material and having a cylindrical bore therethrough, the first section of the forming piece being adjacent to the guide piece, and the cylindrical bore being coaxial with the bore of the forming piece.

4. The extrusion die of claim 3 wherein the guide piece and forming piece comprise a single unitary piece.

5. The extrusion die of claim 3 wherein the guide piece, the forming piece and the case are composed of the high hardness material and comprise a single unitary piece.

6. An extrusion die for extruding tungsten alloy rods, the die comprising:

a case having a cavity, the cavity having an entrance opening and an exit opening, the entrance opening being positioned to receive a tungsten alloy rod and the exit opening being positioned to pass the rod after extrusion, the cavity further containing a guide piece and a forming piece, the guide piece and forming piece being made of a high hardness material having a hardness of at least about 93.8 RA;

the guide piece having a cylindrical bore therethrough and positioned proximal to the entrance opening of the cavity;

the forming piece having a bore therethrough, the bore having a central axis, a first section, a neck and a second section, the bore of the forming piece being coaxial with the cylindrical bore of the guide piece;

the first section, the neck and the second section being cylindrical and coaxial with the central axis of the bore, the neck being interposed between the first and second sections;

the first section being adjacent to the guide piece and having a diameter sufficient to accept the tungsten rod, a first taper interposed between the first section and the neck forming an approach angle with the central axis of the bore, the approach angle being from about 3 to about 7 degrees, the neck having a diameter less than the diameter of the first section and sufficient to reduce the diameter of the tungsten rod by up to about 14%;

the second section having a diameter larger than the neck and sufficient to accept the tungsten rod after extrusion through the neck, a second taper interposed between the neck and the second section and forming an exit angle with the central axis of the bore.

7. The extrusion die of claim 6 wherein the neck has a diameter sufficient to reduce the diameter of the tungsten rod by between about 3 to about 14%.

8. The extrusion die of claim 6 wherein the exit angle is from about 3 to about 10 degrees.

9. An extrusion die for extruding tungsten alloy rods, the die comprising:

a case having a forming piece;

the forming piece having a bore therethrough, the bore having a central axis, a first section, a neck and a second section, the forming piece being made of a high hardness material having a hardness of at least about 93.8 RA;

the first section, the neck and the second section being cylindrical and coaxial with the central axis of the bore of the forming piece, the neck being interposed between the first and second sections;

the first section having a diameter sufficient to accept the tungsten alloy rod, a first taper interposed between the first section and the neck forming an approach angle with the central axis of the bore, the approach angle being no greater than about 9 degrees, the neck having a diameter less than the diameter of the first section and sufficient to reduce the diameter of the tungsten rod by up to about 14%;

the second section having a diameter larger than the diameter of the neck and sufficient to accept the tungsten rod after extrusion through the neck, a second taper interposed between the neck and the second section and forming an exit angle with the central axis of the bore.

10. The extrusion die of claim 9 wherein the neck has a diameter sufficient to reduce the diameter of the tungsten alloy rod by between about 3 to about 14%.

* * * * *